US011523661B2

(12) United States Patent
Schiller et al.

(10) Patent No.: US 11,523,661 B2
(45) Date of Patent: Dec. 13, 2022

(54) SOLE PLATE

(71) Applicant: adidas AG, Herzogenaurach (DE)

(72) Inventors: Nicholas Karl Schiller, Nuremberg (DE); Florian Fleischer, Hessdorf (DE); Stefan Jürgen Schneider, Dietenhofen (DE); David Artner, Nuremberg (DE); Adrien Francois Michel Noirhomme, Nuremberg (DE); Richard Ward, Herzogenaurach (DE); Philipp Alexander Hagel, Nuremberg (DE)

(73) Assignee: ADIDAS AG, Herzogenaurach (DE)

( * ) Notice: Subject to any disclaimer, the term of this patent is extended or adjusted under 35 U.S.C. 154(b) by 283 days.

(21) Appl. No.: 16/002,568

(22) Filed: Jun. 7, 2018

(65) Prior Publication Data

US 2019/0014866 A1 Jan. 17, 2019

(30) Foreign Application Priority Data

Jul. 13, 2017 (DE) ..... 102017212045.2

(51) Int. Cl.

| | |
|---|---|
| ***A43C 15/16*** | (2006.01) |
| ***A43D 25/18*** | (2006.01) |
| ***A43D 86/00*** | (2006.01) |
| ***A43B 13/22*** | (2006.01) |
| ***A43B 5/02*** | (2006.01) |

(52) U.S. Cl.

CPC ..... *A43C 15/161* (2013.01); *A43B 5/02* (2013.01); *A43B 13/223* (2013.01); *A43D 25/18* (2013.01); *A43D 86/00* (2013.01)

(58) Field of Classification Search

CPC ..... A43B 5/02; A43B 23/04; A43B 23/042

See application file for complete search history.

(56) References Cited

U.S. PATENT DOCUMENTS 2,557,535 A * 6/1951 Darragh ..... A43B 9/12 12/142 R
2,955,366 A * 10/1960 Zuckerman ..... A43B 23/042 36/46.5

(Continued)

FOREIGN PATENT DOCUMENTS

DE 102009028627 3/2011
DE 102015200523 7/2016

(Continued)

OTHER PUBLICATIONS

German Patent Application No. DE102017212045.2, Office Action dated Mar. 26, 2018, 15 pages (9 pages of Original Document and 6 pages of English Translation).

(Continued)

*Primary Examiner* — Jila M Mohandesi
(74) *Attorney, Agent, or Firm* — Kilpatrick Townsend & Stockton LLP

(57) ABSTRACT

An article of cleated footwear includes an outsole plate and an upper. The outsole plate includes a rigid first member and a second rigid member. The first rigid member extends substantially along the length of the outsole, and the rigid second member is attached to the first member. The first member and/or the second member has a ground-engaging profile. The upper is attached to the first member.

12 Claims, 3 Drawing Sheets

(56) References Cited

U.S. PATENT DOCUMENTS 2,984,918 A * 5/1961 Glassman ..... A43B 9/02 12/142 F
3,076,215 A * 2/1963 Orlando ..... A43B 9/02 112/421
3,523,379 A * 8/1970 Harut ..... A43B 9/12 36/108
3,757,436 A * 9/1973 Winkler ..... A43B 23/042 36/46.5
3,909,862 A * 10/1975 Auberry ..... A43D 11/00 12/142 R
4,027,406 A * 6/1977 Salvatore ..... A43D 21/00 36/83
4,969,224 A * 11/1990 Birke ..... A43B 9/125 12/142 F
5,152,025 A * 10/1992 Hirmas ..... A43D 21/003 12/145
5,729,918 A * 3/1998 Smets ..... A43B 9/02 12/145
5,765,295 A 6/1998 Srourian et al.
6,243,973 B1 * 6/2001 Lind ..... A43B 13/26 36/100
6,389,712 B1 * 5/2002 Schelling ..... A43B 13/122 36/103
6,421,933 B1 * 7/2002 Zamprogno ..... A43B 5/02 36/114
6,813,847 B2 * 11/2004 Workman ..... A43B 3/18 36/100
7,246,453 B2 * 7/2007 Kim ..... A43B 5/00 36/100
7,536,810 B2 * 5/2009 Jau ..... A43B 5/14 36/131
8,646,191 B2 2/2014 Amos et al.
8,713,819 B2 * 5/2014 Auger ..... A43B 13/12 36/30 R
8,776,403 B2 7/2014 Eder et al.
8,826,569 B2 9/2014 Grott et al.
9,032,645 B2 * 5/2015 Stauffer ..... A43B 5/02 36/67 R
9,113,676 B2 * 8/2015 Campbell ..... A43C 15/161
9,119,438 B2 * 9/2015 Auger ..... A43B 7/143
9,445,645 B2 * 9/2016 Auger ..... A43B 7/1425
9,591,891 B1 * 3/2017 Baucom ..... A43B 13/223
9,907,355 B2 * 3/2018 Barnes ..... A43B 5/14
9,930,934 B2 * 4/2018 Cook ..... A43B 13/026
2006/0010716 A1 * 1/2006 Kerns ..... A43B 13/04 36/25 R
2006/0021255 A1 * 2/2006 Auger ..... A43B 9/02 36/67 A
2009/0056172 A1 * 3/2009 Cho ..... A43B 13/12 36/3 B
2013/0067765 A1 * 3/2013 Auger ..... A43B 13/026 36/31
2013/0139412 A1 * 6/2013 Auger ..... A43B 13/223 36/25 R
2013/0340295 A1 * 12/2013 Adami ..... A43B 13/16 36/25 R
2014/0345164 A1 * 11/2014 Campbell ..... A43C 15/162 36/103
2015/0096198 A1 4/2015 Cavaliere et al.
2015/0305447 A1 * 10/2015 Cavaliere ..... A43B 5/001 36/66
2016/0262494 A1 9/2016 Weidl
2016/0338445 A1 11/2016 Auger et al.
2016/0360829 A1 12/2016 Meschter et al.
2017/0055634 A1 3/2017 Baucom et al.
2017/0150779 A1 * 6/2017 Walker ..... A43B 13/14

FOREIGN PATENT DOCUMENTS

EP 1430803 6/2004
EP 1574143 9/2005

OTHER PUBLICATIONS

European Patent Application No. 18178929.8, European Search Report dated Nov. 23, 2018, 8 pages.
German Application No. DE 102017212045.2, Second Office Action dated Sep. 2, 2019, 12 pages (7 pages of English translation and 5 pages of original document).
European Patent Application No. 21196342.6, Extended Search Report dated Dec. 17, 2021, 8 pages.

* cited by examiner

SOLE PLATE

REFERENCE TO RELATED APPLICATIONS

This application is related to and claims priority benefits from German Patent Application No. DE 10 2017 212 045.2, filed on Jul. 13, 2017, and entitled SOLE PLATE, the content of which is hereby incorporated by reference in its entirety.

FIELD OF THE INVENTION

The present invention relates to an article of cleated footwear, and in particular an article of cleated footwear with a two-piece outsole plate. Moreover, the present invention relates to a method for producing an article of cleated footwear with a two-piece outsole plate.

BACKGROUND

Cleated footwear is used in a variety of sports such as soccer, American football, rugby, golf, baseball, lacrosse, high jump, running, etc. to provide improved grip for an athlete especially on slippery or soft ground. Cleated footwear is subject to particularly high mechanical forces and torques. For this reason, the production of cleated footwear represents challenges not encountered in the production of non-cleated footwear.

It is a firm belief in the prior art that the sole of cleated footwear should therefore be formed of a single piece. As a consequence, the production methods are rather inflexible and the ways to modify an existing article of footwear to adapt it for different requirements based on, for example, the anatomy of the athlete, the sport, the surface properties of the sports ground (e.g. hard, soft, artificial turf) are very limited. Entirely new outsoles have to be designed and manufactured for different models of an article of footwear which is a costly and time-consuming process. Furthermore, an insole board, also known as a lasting board, is typically required to provide sufficient mechanical performance, which adds to the weight of the article of footwear and the complexity of the production process as an upper has to be attached to both the lasting board and the outsole.

Existing solutions to individualize cleated footwear involve exchanging the studs one by one and/or the upper. EP 1 574 143 discloses a studded sports shoe comprising a sock-like upper with an upper side and a lower side, a chassis releasably arranged in the interior of the upper and a plurality of studs, wherein each stud is releasably attached to the chassis through the lower side of the sock-like upper. The disadvantage of this method is that this assembly process is slow and complex. Furthermore, it requires an insole or lasting board and therefore the resulting article of footwear is heavy and has a higher profile than desirable. Furthermore, single studs can get lost easily.

An alternative approach is described in DE 10 2015 2005 23 A1, which discloses a modular shoe, with a sock like outer shoe and a frame. The sock like outer shoe is provided for a releasable arrangement around the frame. The sock like outer shoe may comprise a plurality of profile elements, wherein at least one of the profile elements extends from an outer side of the sock like outer shoe. A region of the at least one of the profile elements may be configured to releasably engage in a formfitting manner with a lower side of the frame of the modular shoe. The disadvantage of this approach is a lower stability of the outer shoe compared with conventional cleated footwear as well as the added weight and increased profile due to the sock like outer shoe.

Several approaches are known in the prior art that use different types of studs in different regions of the sole. U.S. Pat. No. 9,032,645 discloses an article of footwear that may include an upper and a sole structure fixedly attached to a bottom portion of the upper. The sole structure may include a sole component including a baseplate having a bottom surface and at least a first ground engaging member extending substantially downward from the bottom surface of the baseplate, the first ground engaging member having a substantially circular cross-sectional shape. U.S. Pat. No. 8,776,403 discloses an article of footwear including a sole structure with multiple cleat systems. A first cleat system has a first cleat design and one or more cleat member sets that are tuned to provide different levels of traction and flexibility to different regions of the sole structure. A second cleat system has a second cleat design and is disposed on the sole structure in a location to provide maximum traction for various playing surfaces. The sizes, material properties and arrangement of each cleat system are varied.

It is also known that the lasting board can be integrally formed with the molding material to reduce the height profile of the article of footwear. U.S. Pat. No. 8,826,569 discloses a golf shoe including a sole member integrally formed with a molding material, a structural member, and a plurality of receptacles in the bottom of the sole member. The structural member extends along at least a portion of the length of the sole member and is configured to not vertically overlap with any of the receptacles. The shoe disclosed in U.S. Pat. No. 8,826,569 cannot be individualized easily as the lasting board is integrally formed with the molding material. The upper is not lasted directly onto the structural member but instead an additional molding member is required which adds to the complexity and cost of the manufacturing process and increases the weight of the shoe.

It is known in the prior art that a sole of an article of non-cleated footwear can be formed from several pieces. U.S. Pat. No. 5,765,295 discloses a two piece shoe bottom construction including a platform structure and a heel structure. The platform structure has a forward toe support portion and a rear raised portion. The rear raised portion being elevated substantially above the toe portion so that it will correspond to a particular height of a heel portion. U.S. Pat. No. 8,646,191 discloses an article of footwear including an upper and a sole assembly. The sole assembly includes a first member that is coupled to the upper and a second member that is moveably coupled to the first member.

In view of the prior art, there is a considerable need for a novel lightweight yet sturdy article of cleated footwear that can be manufactured in a more flexible and cost-efficient manner.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings, and each claim.

According to certain embodiments, an article of cleated footwear includes an outsole plate and an upper. The outsole plate includes a rigid first member extending substantially along the length of the outsole, and a rigid second member that is attached to the first member. At least one of the first member or the second member has a ground-engaging profile. The upper is attached to the first member.

In some examples, a first part of the upper is lasted around a first region of the first member; and the second member is attached to the first member such that at least a portion of the first part of the upper is arranged between the first member and the second member in at least a portion of the first region. In various aspects, a second part of the upper is sewn to a sheet, and the sheet is attached to a second region of the first member. In certain cases, the second member of the outsole plate extends over at least a portion of the second region and a portion of the first region such that the second member covers the transition point between the second region and the first region. In various cases, the second region includes at least one of a heel region or a shank region of the article of cleated footwear, and the first region includes a forefoot region of the article of cleated footwear. According to some examples, the sheet includes a cut-out region. In some embodiments, the sheet includes at least one of a synthetic material, leather, or a textile. In various cases, the sheet is welded or adhesively attached to the first member.

In various aspects, the first member includes a first ground-engaging profile that comprises at least one stud of a first type, and the second member includes a second ground-engaging profile that comprises at least one stud of a second type. In certain cases, the second member is shorter along a longitudinal direction of the footwear than the first member. In certain examples, the second member includes at least one positioning hole and the first member includes at least one positioning stud which is fitted in a formfitting manner into said positioning hole.

In some aspects, at least one of the first member or the second member contains weight-reducing perforations. In various examples, cleated footwear according to claim 1, wherein the first member comprises a heel counter. According to certain cases, the second member includes a spine fitted in a formfitting manner into a corresponding recess in the first member. In some embodiments, the first member includes at least one of polyamide 11 or polyamide 12, and the second member includes at least one of thermoplastic polyurethane, polyurethane, or polyether block amide. In various examples, the second member is removably attached to the first member. In certain cases, the second member is permanently attached to the first member.

According to various embodiments, a method for producing an article of cleated footwear includes supplying an outsole plate including forming a rigid first member that extends substantially along the length of the outsole, and forming a rigid second member, wherein at least one of the first member or the second member comprises a ground-engaging profile. The method includes supplying an upper, attaching the upper to the first member, and attaching the first member to the second member.

In various aspects, attaching the upper to the first member includes lasting a first part of the upper around a first region of the first member, and arranging at least a portion of the first part of the upper between the first member and the second member in at least a portion of the first region. In certain cases, attaching the upper to the first member includes sewing a second part of the upper to a sheet and attaching the sheet to a second region of the first member. In some examples, the method includes arranging the second member of the outsole plate to extend over at least a part of the second region and a part of the first region such that the second member covers the transition point between the second region and the first region. In certain cases, the method includes arranging the second region in at least one of a heel region or a shank region of the article of cleated footwear, and arranging the first region in a forefoot region of the article of cleated footwear. According to some embodiments, the method includes forming a cut-out region in the sheet. In certain cases, the sheet includes at least one of a synthetic material, leather, or a textile. In some aspects, attaching the sheet to the first member includes welding or adhesively attaching the sheet to the first member.

In certain cases, at least one of the first member or the second member are injection-molded. In some aspects, the first member includes a first ground-engaging profile that includes at least one stud of a first type, and the second member comprises a second ground-engaging profile that includes at least one stud of a second type. In some examples, the second member is formed to be shorter along a longitudinal direction of the outsole than the first member.

In some examples, the method includes forming at least one positioning hole in the second member, forming at least one positioning stud in the first member, and formfitting the positioning stud into the positioning hole when the first member is attached to the second member. In certain aspects, the method includes forming weight-reducing perforations in at least one of the first member or the second member.

In some aspects, the method includes forming a heel counter in the first member. In various examples, the method includes forming a spine in the second member and forming a corresponding recess in the first member. In certain aspects, the first member includes at least one of polyamide 11 or polyamide 12, and the second member includes at least one of thermoplastic polyurethane, polyurethane, or polyether block amide. According to some examples, attaching the first member to the second member forms a non-detachable connection. In various cases, attaching the first member to the second member forms a detachable connection.

Various implementations described in the present disclosure can include additional systems, methods, features, and advantages, which cannot necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

Possible embodiments of the present invention are further described in the following detailed description, with reference to the following figures.

BRIEF DESCRIPTION

Figure 1:
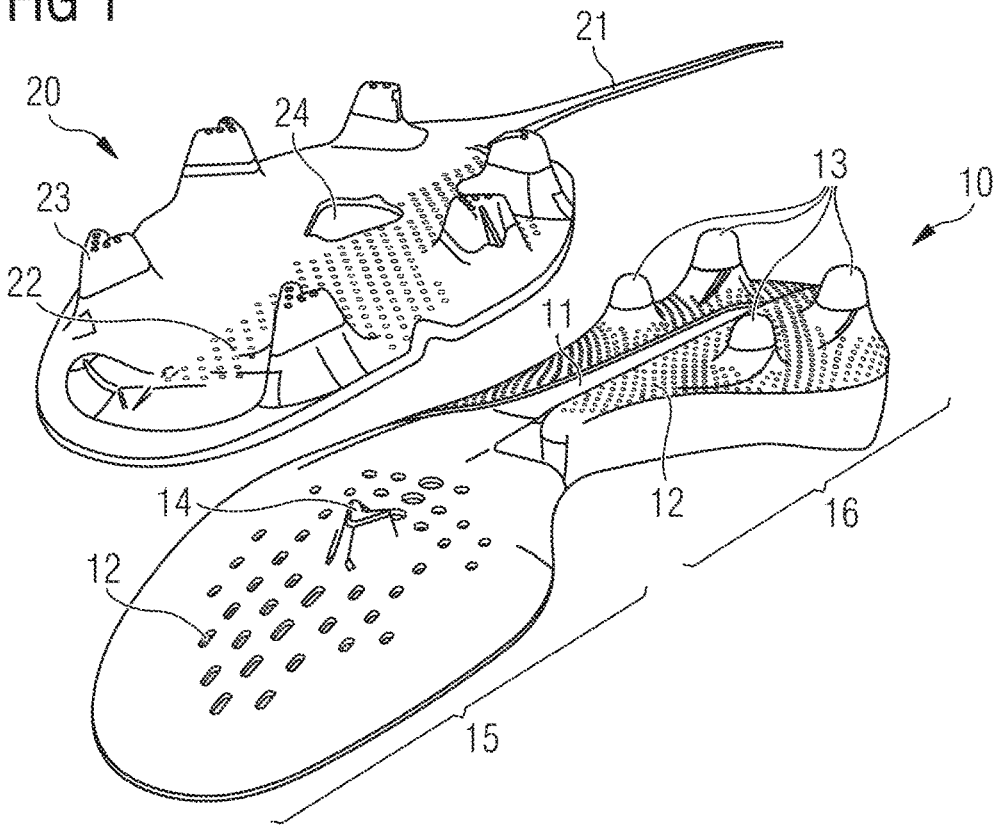
FIG. 1 illustrates an example of a first member and a second member of an outsole plate for an article of footwear according to aspects of the present invention.

The above mentioned problem is at least partly solved by an article of cleated footwear comprising: an outsole plate comprising (i) a rigid first member, extending substantially along the length of the outsole, and (ii) a rigid second member, (iii) wherein the second member is attached to the first member, and (iv) wherein the first member and/or the second member has a ground-engaging profile; and an upper attached to the first member.

The first member is also called "chassis" and the second member is also called "skin". An article of cleated footwear in the present context has a ground-engaging profile which is to be understood to be any profile whose purpose it is to improve the grip of the sole by partly penetrating the ground. For example, the ground-engaging profile could comprise studs such as studs for football boots, spikes such as spikes for running shoes, studs for hiking or walking boots, or any other textured profile whose purpose it is to partly penetrate the ground and thus to improve the grip of the sole. The term ground-engaging profile here does not apply to a sole element whose purpose it is to simply make touching contact with the ground, for example any part of the sole of high-heeled shoes as these are not intended to partly penetrate the ground in order to improve the grip.

The first member and the second member may have a ground-engaging profile in which case both the first member and the second member provide grip and stability. Alternatively, just the second member may have a ground-engaging profile in which case the second member provides grip and the first member provides stability. Alternatively, just the first member may have a ground-engaging profile in which case the first member provides grip and stability, and the second member improves the stability in those regions where it is most required.

The upper may be attached to the first member by any suitable means such as, for example, by means of an adhesive or by welding. The first member may be attached to the second member by any suitable means such as, for example, by means of an adhesive or by welding.

The first member is rigid and extends substantially along the length of the outsole of the article of footwear. Thus, the length of the first member is preferably at least 50% of the length of the outsole of the article of footwear, more preferably at least 75%, most preferably 100%, wherein the length is measured along a longitudinal direction of the outsole of the article of footwear. The first member therefore serves as the primary element for providing a structure to the outsole. Unlike an insole or lasting board, the first member may have a first ground-engaging profile. The first member therefore may have both the structural function of an insole or lasting board in that it provides rigidity to the sole, but the first member may further provide some of the grip properties of the outsole. The use of a first member therefore allows a simpler and more lightweight construction than a conventional insole board combined with a second element with an outsole profile. With this construction, an insole board is not required, which simplifies the construction of the sole, saving processing time and costs and leads to an article of footwear with a lower total weight without sacrificing mechanical performance. The inventors have discovered that a weight reduction is possible due to this improved construction.

The second member preferably has a longitudinal length of at least 20% of the length of the first member, more preferably 30%. It is to be understood that the second member is not merely a stud. A function of the second member is to provide an ideal level of grip for the athlete whilst maintaining a low weight and good wearing comfort. The second member can be constructed to suit any particular sport or surface of sports grounds. Thus, during production, the same type of first member can be used for articles of footwear of different type (e.g. soccer shoe, rugby shoe, etc.), while only the second member is varied. This is contrary to conventional cleated footwear, for which, starting from a particular shoe, the entire soleplate has to be re-designed and manufactured even for a similar shoe that is used on a different surface (e.g. hard, soft, artificial turf), a different sport, or by a different type of athlete (e.g. beginner, ambitious amateur, professional, etc.).

Another advantage of this construction lies in the modular nature of the sole plate which simplifies the assembly of said soleplate by the manufacturer, for instance at a factory or at a store. Each piece, the first member and the second member, could be made from different materials and undergo different treatment to achieve particular mechanical or design properties. It is also feasible that a customer can easily and flexibly modify the article of cleated footwear after purchase. Thus, a customer does not have to purchase an entirely new shoe for a new activity, resulting in a favorable environmental impact.

Summarizing the above, an article of footwear according to the invention is of low weight is easy to assemble, can be individualized and modified quickly and at low cost, resulting in cost savings and a favorable environmental impact. The modularity of the sole plate results in a flexible and cost-efficient manufacturing process. Such articles of footwear could be used in a variety of sports, comprising football (soccer), American football, lacrosse, baseball, rugby, golf, running, high jump, or any other sport or activity requiring cleated footwear.

A first part of the upper may be lasted around a first region of the first member; and the second member may be attached to the first member such that at least a portion of the first part of the upper is arranged between the first member and the second member in at least a portion of the first region.

This arrangement is also referred to as board lasted as it is preferably carried out while the upper is arranged on a last and the first member (the board) arranged between a portion of the upper and the last. In order words, the upper is lasted around the first member and "sandwiched" between the first and the second member. The upper is then attached to the first and/or the second member by gluing and/or welding, and/or any other suitable means. In this construction, the connection of the sole and the upper is particularly stable and the risk of the upper tearing off is greatly reduced. This arrangement also allows to directly last the upper onto the first member in the first region. This makes an insole board redundant and reduces the number of components and the weight of the article of footwear while maintaining good mechanical stability.

This construction also prevents the formation of wrinkles in the toe area of the upper which is a frequent problem in cleated footwear where the tooling toe lip is low. As the upper is lasted around the first member, the rigid first member maintains sufficient tension in the upper in order to prevent the formation of wrinkles.

A second part of the upper may be sewn to a sheet and the sheet may be attached to a second region of the first member. For example, the upper could be sewn using a Strobel sewing machine. The sheet-like material could be made from a synthetic material, leather, and/or a textile. The sheet-like material may be from the same material as the upper, or any other suitable material. It is also feasible that the upper is directly sewn to the first member. This construction allows the overall weight of the article of footwear to be reduced as it is more lightweight than the configuration in the first region. It is also faster and easier to assemble the article of footwear in this second region than to perform the board lasting in the first region.

The second member of the outsole plate may extend over at least a portion of the second region and a portion of the first region, such that the second member covers the transition point between the second region and the first region.

It is functional if the second member extends over the transition point on the first member at which the method of attachment of the upper changes from lasting to being sewn. It is beneficial if this transition point is covered by the second member because the upper could tear at this point or detach from the first member. The transition point must be carefully selected because if the board lasting is cut off too early, that is if the board lasted area is too short, the interface between the second member and the first member won't be flush at the transition point which is required for the mechanical stability, especially of cleated footwear. If, however, the board lasted area is too long, the weight of the article of footwear is increased unnecessarily.

The second region may comprise a heel region and/or a shank region of the article of cleated footwear; and/or the first region may comprise a forefoot region of the article of cleated footwear.

To reduce stud tip pressure on the foot, it is beneficial that the upper is lasted around the first member in a forefoot region of the first member.

The sheet to which the upper may be sewn in the second region may comprise a cut-out region. The inventors have found that it is possible to still provide a stable connection of the upper to the first member if the sheet comprises a cut-out region. A cut-out region is an area in the sheet where a hole is formed in the sheet or where the material of the sheet is thinner than in another region. Preferably the cut-out region is at the center of the sheet. A hole may be cut into the sheet before or after sewing the upper to the sheet. Alternatively, a hole could be formed in the sheet while the sheet is produced. Another alternative is that the material of the sheet it made thinner in part of the sheet by mechanical means such as grinding or by chemical means such as etching. The cut-out region reduces the weight of the article of footwear.

The sheet may comprise a synthetic material, leather, and/or a textile. The sheet may be from the same material as the upper. These materials are advantageous because they are durable and prevent the upper from tearing where it is sewn to the sheet and provide a comfortable level of cushioning.

The sheet may be attached to the first member by means of an adhesive and/or by welding. An adhesive is a simple way of forming a strong and permanent bond. If the materials used allow welding, then welding may be a preferred method as it does not require the use of an additional adhesive, yet allows a strong bond to be formed.

The first member may comprise a first ground-engaging profile, which comprises at least one stud of a first type; and/or the second member may comprise a second ground-engaging profile, which comprises at least one stud of a second type.

The advantage of such a configuration is that an optimal grip can be achieved by allowing different types of studs for different parts of the foot. For instance, one could choose relatively large studs on the first member in the heel area, which may bear most of the athlete's weight when standing or walking, while finer studs may be more appropriate on the second member in the forefoot area, to improve the athlete's performance when running, when most of the athlete's weight would be on the forefoot area.

The second member may be shorter along a longitudinal direction of the footwear than the first member. A shorter second member allows for greater flexibility of the sole and a lower weight.

The second member may comprise at least one positioning hole and the first member may comprise at least one positioning stud which is fitted in a formfitting manner into said positioning hole. A positioning hole and a positioning stud improve the stability of the outsole construction and also ensures a proper alignment of the first and second member. Preferably, the positioning stud, and the corresponding positioning hole, is not circular in order to prevent a rotation of the second member when transverse torques act upon the second member. Furthermore, a positioning stud in the first member that is arranged through a positioning hole in the second member adds grip in the region of the second member such that the second member does not necessarily have to comprise a stud or ground engaging profile, allowing a further weight reduction.

The first member and/or the second member may contain weight-reducing perforations. A suitable choice of perforation profile allows a construction of the sole that is more lightweight yet that maintains a similar structural stability as an un-perforated counterpart. Normally, ribs are placed on the outside of a boot chassis for required stiffness. It is possible to achieve a similar stiffness by forming a perforation comprising holes arranged longitudinally against flex direction so as to form a rib-like structure between the rows of holes. By choosing a location of the holes around the thickest areas of the first and/or second member it is possible to achieve a maximum amount of weight reduction, while maintaining stability and good manufacturing properties. A weight reduction of the sole benefits an athlete in both greater wearing comfort and improved performance.

The first member may comprise a heel counter. A heel counter allows greater support of the athlete's foot in sports where such increased support is required. Moreover, by combining the heel counter with a portion of the outsole, the stability is even more increased.

The second member may comprise a spine fitted in a formfitting manner into a corresponding recess in the first member. The spine provides additional stability for the second member against forces transverse to the direction of the spine. The spine may also improve the look and design of an article of footwear The first member may be made from polyamide 11 and/or polyamide 12 and/or the second member may be made from thermoplastic polyurethane, polyurethane, or polyether block amide. Polyamide 11 and polyamide 12 provide a good rigidity, elastic, and shear properties while thermoplastic polyurethane, polyurethane, or polyether block amide are light-weight, flexible, and have good damping properties.

The second member may be attached to the first member in a non-detachable manner. For certain sports or activities, it may be desirable to have a maximum level of stability, which could be best achieved by a non-detachable connection of the second member to the first member.

The second member may be attached to the first member in a detachable manner. By allowing the second member to be detached from the first member, the outsole could be modified after purchase. A customer could choose, for instance, a second member that provides ideal grip for a particular sport and on a particular surface. The customer could then freely combine this second member with a first member that provides a preferred level of heel support for a customer's personal preference. Such a modification could be carried out by the customer himself, or by a service provider, for example in a store. The detachable connection could be provided by any suitable means, for example there may be a thread in the first member and a screw placed through the second member could be used to fix the second member to the first member. The screw could be integrally formed with the ground engaging profile, in particular with a stud.

The invention further concerns a method for producing an article of cleated footwear, comprising: (a) supplying an outsole plate, comprising (i) forming a rigid first member, extending substantially along the length of the outsole, and (ii) forming a rigid second member, wherein the first member and/or the second member comprise a ground-engaging profile; (b) supplying an upper; (c) attaching the upper to the first member; and (d) attaching the first member to the second member.

Step (c) attaching the upper to the first member is preferably performed before step (d) attaching the first member to the second member.

The first member is also called "chassis" and the second member is also called "skin". An article of cleated footwear in the present context has a ground-engaging profile which is to be understood to be any profile whose purpose it is to improve the grip of the sole by partly penetrating the ground. For example, the ground-engaging profile could comprise studs such as studs for football boots, spikes such as spikes for running shoes, studs for hiking or walking boots, or any other textured profile whose purpose it is to partly penetrate the ground and thus to improve the grip of the sole. The term ground-engaging profile here does not apply to a sole element whose purpose it is to simply make touching contact with the ground, for example any part of the sole of high-heeled shoes as these are not intended to partly penetrate the ground in order to improve the grip.

The first member and the second member may have a ground-engaging profile in which case both the first member and the second member provide grip and stability. Alternatively, just the second member may have a ground-engaging profile in which case the second member provides grip and the first member provides stability. Alternatively, just the first member may have a ground-engaging profile in which case the first member provides grip and stability, and the second member improves the stability in those regions where it is most required.

The upper may be attached to the first member by any suitable means such as, for example, by means of an adhesive or by welding. The first member may be attached to the second member by any suitable means such as, for example, by means of an adhesive or by welding.

The first member is rigid and extends substantially along the length of the outsole of the article of footwear. Thus, the length of the first member is preferably at least 50% of the length of the outsole of the article of footwear, more preferably at least 75%, most preferably 100%, wherein the length is measured along a longitudinal direction of the outsole of the article of footwear. The first member therefore serves as the primary element for providing a structure to the outsole. Unlike an insole or lasting board, the first member may have a first ground-engaging profile. The first member therefore may have both the structural function of an insole or lasting board in that it provides rigidity to the sole, but the first member may further provide some of the grip properties of the outsole. The use of a first member therefore allows a simpler and more lightweight construction than a conventional insole board combined with a second element with an outsole profile. With this construction, an insole board is not required, which simplifies the construction of the sole, saving processing time and costs and leads to an article of footwear with a lower total weight without sacrificing mechanical performance. The inventors have discovered that a weight reduction is possible due to this improved construction.

The second member preferably has a longitudinal length of at least 20% of the length of the first member, more preferably 30%. It is to be understood that the second member is not merely a stud. A function of the second member is to provide an ideal level of grip for the athlete whilst maintaining a low weight and good wearing comfort. The second member can be constructed to suit any particular sport or surface of sports grounds. Thus, during production, the same type of first member can be used for articles of footwear of different type (e.g. soccer shoe, rugby shoe, etc.), while only the second member is varied. This is contrary to conventional cleated footwear, for which, starting from a particular shoe, the entire soleplate has to be re-designed and manufactured even for a similar shoe that is used on a different surface (e.g. hard, soft, artificial turf), a different sport, or by a different type of athlete (e.g. beginner, ambitious amateur, professional, etc.).

Another advantage of this construction lies in the modular nature of the sole plate which simplifies the assembly of said soleplate by the manufacturer, for instance at a factory or at a store. Each piece, the first member and the second member, could be made from different materials and undergo different treatment to achieve particular mechanical or design properties. It is also feasible that a customer can easily and flexibly modify the article of cleated footwear after purchase. Thus, a customer does not have to purchase an entirely new shoe for a new activity, resulting in a favorable environmental impact.

Summarizing the above, an article of footwear according to the invention is of low weight is easy to assemble, can be individualized and modified quickly and at low cost, resulting in cost savings and a favorable environmental impact. The modularity of the sole plate results in a flexible and cost-efficient manufacturing process. Such articles of footwear could be used in a variety of sports, comprising football (soccer), American football, lacrosse, baseball, rugby, golf, running, high jump, or any other sport or activity requiring cleated footwear.

Attaching the upper to the first member may comprise: (a) lasting a first part of the upper around a first region of the first member; and (b) arranging at least a portion of the first part of the upper between the first member and the second member in at least a portion of the first region. In this case, step (c) attaching the upper to the first member is preferably performed before step (d) attaching the first member to the second member in order to simplify the step of attaching the upper to the first member.

This arrangement is also referred to as board lasted as it is preferably carried out while the upper is arranged on a last and the first member (the board) arranged between a portion of the upper and the last. In order words, the upper is lasted around the first member and "sandwiched" between the first and the second member. The upper is then attached to the first and/or the second member by gluing and/or welding, and/or any other suitable means. In this construction, the connection of the sole and the upper is particularly stable and the risk of the upper tearing off is greatly reduced. This arrangement also allows to directly last the upper onto the first member in the first region. This makes an insole board redundant and reduces the number of components and the weight of the article of footwear while maintaining good mechanical stability.

This construction also prevents the formation of wrinkles in the toe area of the upper which is a frequent problem in cleated footwear where the tooling toe lip is low. As the upper is lasted around the first member, the rigid first member maintains sufficient tension in the upper in order to prevent the formation of wrinkles.

The upper may be attached to the first member by sewing a second part of the upper to a sheet and attaching the sheet to a second region of the first member. For example, the upper could be sewn using a Strobel sewing machine. The sheet-like material could be made from ethyl vinyl acetate, polyurethane, the same material as the upper, or any other suitable material. It is also feasible that the upper is directly sewn to the first member.

This construction allows the overall weight of the article of footwear to be reduced as it is more lightweight than the configuration in the first region. It is also faster and easier to assemble the article of footwear in this second region than to perform the board lasting in the first region.

The method may comprise arranging the second member of the outsole plate to extend over at least a part of the second region and a part of the first region, such that the second member covers the transition point between the second region and the first region.

It is functional if the second member extends over the transition point on the first member at which the method of attachment of the upper changes from lasting to being sewn. It is beneficial if this transition point is covered by the second member because the upper could tear at this point or detach from the first member. The transition point must be carefully selected because if the board lasting is cut off too early, that is if the board lasted area is too short, the interface between the second member and the first member won't be flush at the transition point which is required for the mechanical stability, especially of cleated footwear. If, however, the board lasted area is too long, the weight of the article of footwear is increased unnecessarily.

The method may further comprise: (a) arranging the second region in a heel region and/or a shank region of the article of cleated footwear; and/or (b) arranging the first region in a forefoot region of the article of cleated footwear To reduce stud tip pressure on the foot, it is beneficial that the upper is lasted around the first member in a forefoot region of the first member.

The method may further comprise forming a cut-out region in the sheet. The inventors have found that it is possible to still provide a stable connection of the upper to the first member if the sheet comprises a cut-out region. A cut-out region is an area in the sheet where a hole is formed in the sheet or where the material of the sheet is thinner than in another region. Preferably the cut-out region is at the center of the sheet. A hole may be cut into the sheet before or after sewing the upper to the sheet. Alternatively, a hole could be formed in the sheet while the sheet is produced. Another alternative is that the material of the sheet it made thinner in part of the sheet by mechanical means such as grinding or by chemical means such as etching. The cut-out region reduces the weight of the article of footwear.

The sheet may be made from a synthetic material, leather, and/or a textile. The sheet may be from the same material as the upper. These materials are advantageous because they are durable and prevent the upper from tearing where it is sewn to the sheet and provide a comfortable level of cushioning.

Attaching the sheet to the first member may comprise using an adhesive and/or welding. An adhesive is a simple way of forming a strong and permanent bond. If the materials used allow welding, then welding may be a preferred method as it does not require the use of an additional adhesive, yet allows a strong bond to be formed.

The first member and/or the second member may be formed by injection-molding. Injection molding is a cost-effective and simple method of forming solid components, that are made from a meltable material, even with complex shapes in a reproducible manner.

The first member may comprise a first ground-engaging profile, which comprises at least one stud of a first type and/or the second member may comprise a second ground-engaging profile, which comprises at least one stud of a second type.

The advantage of such a configuration is that an optimal grip can be achieved by allowing different types of studs for different parts of the foot. For instance, one could choose relatively large studs on the first member in the heel area, which may bear most of the athlete's weight when standing or walking, while finer studs may be more appropriate on the second member in the forefoot area, to improve the athlete's performance when running, when most of the athlete's weight would be on the forefoot area.

The second member may be formed to be shorter along a longitudinal direction of the outsole than the first member. A shorter second member allows for greater flexibility of the sole and a lower weight.

The method may further comprise forming at least one positioning hole in the second member and at least one positioning stud in the first member, wherein the positioning stud is fitted in a formfitting manner into the positioning hole, when the first member is attached to the second member. A positioning hole and a positioning stud improve the stability of the outsole construction and also ensures a proper alignment of the first and second member. Preferably, the positioning stud, and the corresponding positioning hole, is not circular in order to prevent a rotation of the second member when transverse torques act upon the second member. Furthermore, a positioning stud in the first member that is arranged through a positioning hole in the second member adds grip in the region of the second member such that the second member does not necessarily have to comprise a stud or ground engaging profile, allowing a further weight reduction.

The method may further comprise forming weight-reducing perforations in the first member and/or the second member. A suitable choice of perforation profile allows the construction of a sole that is more lightweight yet that maintains a similar structural stability as an un-perforated counterpart. Normally, ribs are placed on the outside of a boot chassis for required stiffness. It is possible to achieve a similar stiffness by forming a perforation comprising holes arranged longitudinally against flex direction so as to form a rib-like structure between the rows of holes. By choosing a location of the holes around the thickest areas of the first and/or second member it is possible to achieve a maximum amount of weight reduction, while maintaining stability and good manufacturing properties. A weight reduction of the sole benefits an athlete in both greater wearing comfort and improved performance.

The method may further comprise forming a heel counter in the first member. A heel counter allows greater support of the athlete's foot in sports where such increased support is required. Moreover, by combining the heel counter with a portion of the outsole, the stability is even more increased.

The method may further comprise forming a spine in the second member and forming a corresponding recess in the first member. The spine provides additional stability for the second member against forces transverse to the direction of the spine. The spine may also improve the look and design of an article of footwear.

The first member may be made from polyamide 11 and/or polyamide 12 and/or the second member may be made from thermoplastic polyurethane, polyurethane, or polyether block amide. Polyamide 11 and polyamide 12 provide a good rigidity, elastic, and shear properties while thermoplastic polyurethane, polyurethane, or polyether block amide are light-weight, flexible, and have good damping properties.

Attaching the first member to the second member may form a non-detachable connection. For certain sports or activities, it may be desirable to have a maximum level of stability, which could be best achieved by a non-detachable connection of the second member to the first member.

Attaching the first member to the second member may form a detachable connection. By allowing the second member to be detached from the first member, the outsole could be modified after purchase. A customer could choose, for instance, a second member that provides ideal grip for a particular sport and on a particular surface. The customer could then freely combine this second member with a first member that provides a preferred level of heel support for a customer's personal preference. Such a modification could be carried out by the customer himself, or by a service provider, for example in a store. The detachable connection could be provided by any suitable means, for example there may be a thread in the first member and a screw placed through the second member could be used to fix the second member to the first member. The screw could be integrally formed with the ground engaging profile, in particular with a stud.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

In the following, only some exemplary embodiments of the invention are described in detail. These exemplary embodiments can be modified in a number of ways and combined with each other whenever compatible and certain features may be omitted in so far as they appear dispensable. The scope of the invention is determined only by the independent claims and is not limited by any of the exemplary embodiments.

FIG. 1 shows a preferred embodiment of a rigid first member 10, also known as chassis, and a rigid second member 20, also known as skin, according to the present invention.

The first member 10 is rigid and extends substantially along the length of the outsole of the article of footwear. Thus, the length of the first member 10 is preferably at least 50% of the length of the outsole of the article of footwear, more preferably at least 75%, most preferably 100%, wherein the length is measured along a longitudinal direction of the outsole of the article of footwear. The first member 10 therefore serves as the primary element for providing a structure to the outsole. Unlike an insole or lasting board, the first member 10 may have a first ground-engaging profile. The first member 10 therefore may have both the structural function of an insole or lasting board in that it provides rigidity to the sole, but the first member 10 may further provide some of the grip properties of the outsole. The use of a first member 10 therefore allows a simpler and more lightweight construction than a conventional insole board combined with a second element with an outsole profile. With this construction, an insole board is not required, which simplifies the construction of the sole, saving processing time and costs and leads to an article of footwear with a lower total weight without sacrificing mechanical performance. The inventors have discovered that a weight reduction is possible due to this improved construction.

The first member 10 and/or the second member 20 could be formed from injection molding or any another suitable technique. The first member 10 could be made from polyamide 11 and/or polyamide 12, which provide a good rigidity, elastic, and shear properties. The second member 20 could be made from thermoplastic polyurethane, polyurethane, or polyether block amide. Thermoplastic polyurethane, polyurethane, or polyether block amide are light-weight, flexible, and have good damping properties. The first and second member 20 could also be made from other materials and they could be made from the same material or from different materials.

The second member 20 preferably has a longitudinal length of at least 20% of the length of the first member, more preferably 30%. It is to be understood that the second member 20 is not merely a stud. A function of the second member 20 is to provide an ideal level of grip for the athlete whilst maintaining a low weight and good wearing comfort. The second member 20 can be constructed to suit any particular sport or surface of sports grounds. Thus, during production, the same type of first member can be used for articles of footwear of different type (e.g. soccer shoe, rugby shoe, etc.), while only the second member 20 is varied. This is contrary to conventional cleated footwear, for which, starting from a particular shoe, the entire soleplate has to be re-designed and manufactured even for a similar shoe that is used on a different surface (e.g. hard, soft, artificial turf), a different sport, or by a different type of athlete (e.g. beginner, ambitious amateur, professional, etc.).

Another advantage of this construction lies in the modular nature of the sole plate which simplifies the assembly of said soleplate by the manufacturer, for instance at a factory or at a store. Each piece, the first member 10 and the second member 20, could be made from different materials and undergo different treatment to achieve particular mechanical or design properties. It is also feasible that a customer can easily and flexibly modify the article of cleated footwear after purchase. Thus, a customer does not have to purchase an entirely new shoe for a new activity, resulting in a favorable environmental impact.

In the exemplary embodiment of FIG. 1, the first member 10 contains weight-reducing perforations 12 in both the forefoot region 15 and the heel region 16. The second member 20 also contains weight-reducing perforations 22 which are also formed on the studs 23. A suitable choice of perforation profile allows the construction of the sole that is more lightweight yet that maintains a similar structural stability as an un-perforated counterpart. Normally, ribs are placed on the outside of a boot chassis for required stiffness. It is possible to achieve a similar stiffness by forming a perforation comprising holes arranged longitudinally against flex direction so as to form a rib-like structure between the rows of holes. By choosing a location of the holes around the thickest areas of the first and/or second member it is possible to achieve a maximum amount of weight reduction, while maintaining stability and good manufacturing properties. A weight reduction of the sole benefits an athlete in both greater wearing comfort and improved performance.

The first member 10 contains a number of studs of a first type 13 in the heel region 16 to provide basic grip for the athlete. A recess 11 is formed in the first member 10 to accept the spine 21 of the second member 20 to provide further stability for the attachment of the spine on the first member 10 against forces transverse to the direction of the spine 21.

In the exemplary embodiment of FIG. 1, a positioning stud 14 is present to allow accurate and stable alignment of the second member 20 with respect to the first member 10 by means of a positioning hole 24 formed in the second member 20. The positioning hole 24 and the positioning stud 14 can be chosen to have a particular size and shape depending on the needed stability. There may be more than one positioning stud and corresponding positioning hole. Preferably, the positioning stud 14, and the corresponding positioning hole 24, is not circular in order to prevent a rotation of the second member 20 when transverse torques act upon the second member 20. Furthermore, a positioning stud 14 in the first member 10 that is arranged through a positioning hole 24 in the second member 20 adds grip in the region of the second member 20 such that the second member 20 does not necessarily have to comprise a stud or ground engaging profile, allowing a further weight reduction.

The studs 23 on the second member 20 are located close to the forefoot region 15 of the first member 10. The number and shape of the studs 23 can be chosen for a specific type of surface of the sports ground and/or a particular sport.

In this preferred embodiment, the studs 23 on the second member 20 are of a different shape than the studs 13 on the first member 10. Here, the studs 23 on the second member 20 are v-shaped to enable optimal performance for the athlete during running, when most of the athlete weight is on the forefoot region. The studs 13 on the first member are of a circular cross-section, to allow the athlete to turn quickly when walking or standing, when most of the athlete's weight on the heel region.

The second member 20 is shorter along a longitudinal direction than the first member 10 in this embodiment. A shorter second member 20 allows for greater flexibility of the sole and a lower weight.

The outsole plate is formed by attaching the second member 20 to the first member 10, for example by using an adhesive, while ensuring the alignment of the positioning hole 24 with the positioning stud 14 and of the spine 21 with the recess 11.

In an alternative embodiment, the attachment could be facilitated by using screws in order to provide a detachable connection. In another alternative embodiment, the first member could include forefoot studs and the second member could have fewer studs to make the board lasting area shorter.

Preferably, a first part of the upper 30*a* is lasted around a first region 35 of the first member 10 and the second member 20 is attached to the first member 20 such that at least a portion of the first part of the upper 30*a* is arranged between the first member 10 and the second member 20 in at least a portion of the first region 35. This is described in more detail with reference to FIG. 3 below.

Figure 2:
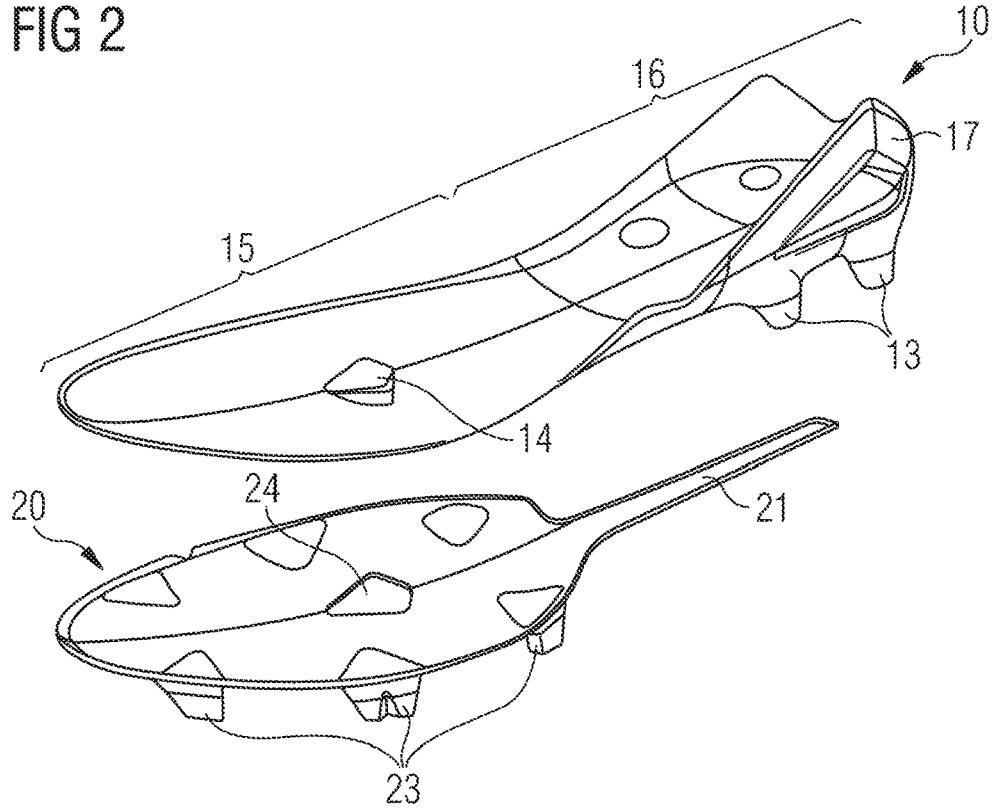
FIG. 2 illustrates another example of a first member and a second member of an outsole plate for an article of footwear according to aspects of the present invention.

FIG. 2 shows another example of an outsole plate according to the present invention. The outsole plate of FIG. 2 does not have weight reducing perforations. FIG. 2 schematically shows an arrangement of a first member 10 and a second member 20 in an exploded view of an exemplary embodiment. The second member contains a positioning hole 24 which can be brought in formfitting conjunction with the positioning stud 14 of the first member 10 to provide good stability. The second member 20 also contains several studs 23 for providing ideal grip for the athlete, depending on the surface of the sports ground and the sport. The first member contains several studs 13 for basic grip at the heel and a heel counter 17 for supporting the athlete's heel.

FIGS. 3A-D show an exemplary arrangement of an upper 30 and a first member 10, forming part of an article of cleated footwear according to the present invention. The second member 20 has been omitted for clarity.

Figure 3A:
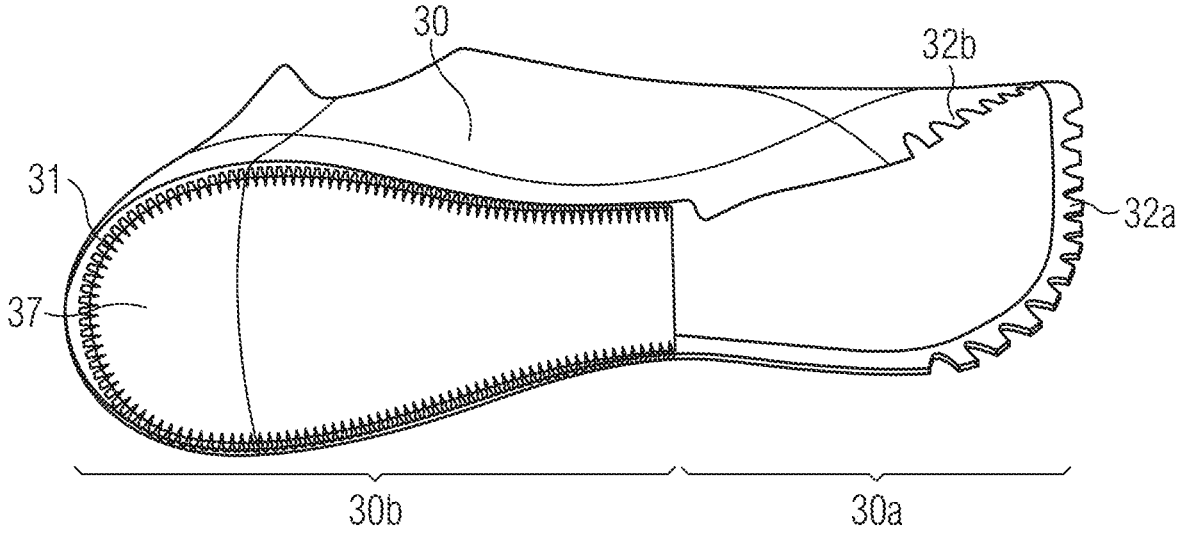
FIGS. 3A-D illustrate an example of an article of footwear comprising an outsole plate according to aspects of the present invention, and an exemplary method for producing the article of footwear.

FIG. 3A shows an upper 30 comprising a second part 30*b* and a first part 30*a*. The second part 30*b* is sewn to a sheet-like material 37. The stitching 31 is preferably located at a rim of the upper. The sheet-like material is substantially similar to a sheet and is also referred to as sheet 37. The sheet 37 could be made from ethyl vinyl acetate, polyurethane, a textile material (e.g. a woven material), the same material as the upper, or any other suitable material. The purpose of the sheet is to provide some cushioning to the wearer of the article of footwear and a tear-resistant means for attaching the second part 30*b* of the upper 30 to the first member 10. The sewing may, for example, be performed using a Strobel sewing machine. The first part 30*a* of the upper is open and comprises ears with an outside surface 32*b* and an inner surface 32*a*. The ears 32 are functional for facilitating the lasting of the upper as explained with reference to FIG. 3D below.

Figure 3B:
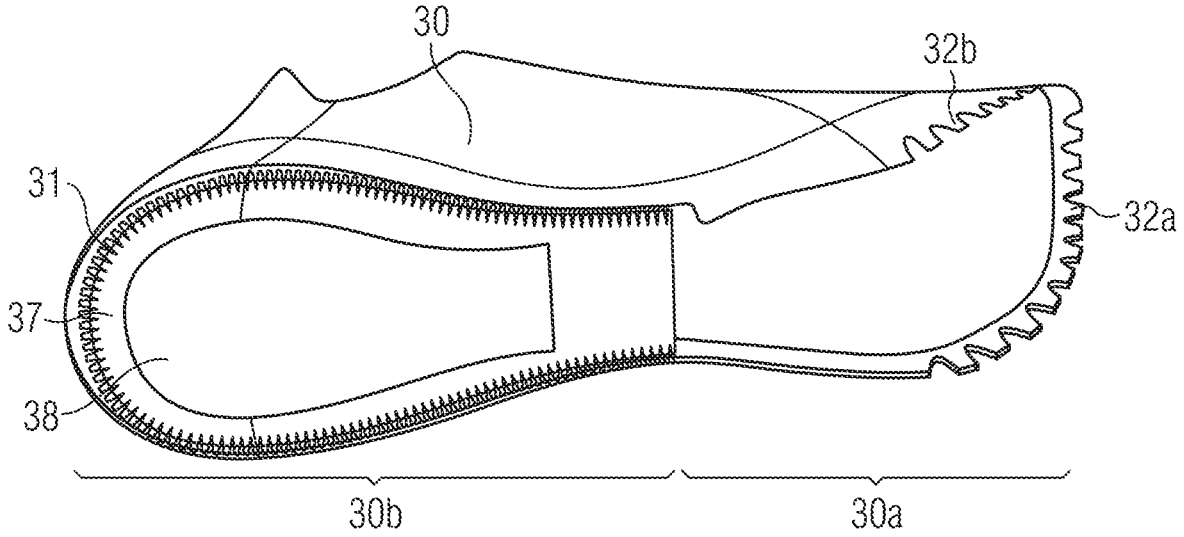

FIG. 3B shows an alternative version of FIG. 3A, in which a cut-out region 38 is formed in the sheet 37. The inventors have found that it is possible to still provide a stable connection of the upper 30 to the first member 10 if the sheet comprises a cut-out region 38. A cut-out region 38 is an area in the sheet where a hole is formed in the sheet or where the material of the sheet is thinner than in another region. Preferably the cut-out region 38 is at the center of the sheet. A hole may be cut into the sheet before or after sewing the upper to the sheet. Alternatively, a hole could be formed in the sheet while the sheet is produced. Another alternative is that the material of the sheet it made thinner in part of the sheet by mechanical means such as grinding or by chemical means such as etching. The cut-out region 38 reduces the weight of the article of footwear.

Figure 3C:
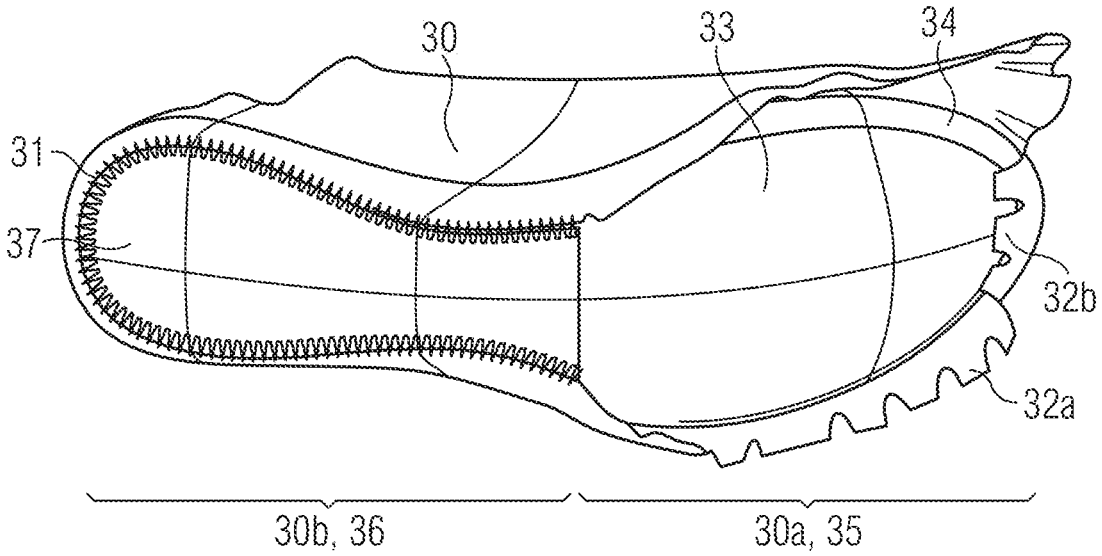
Figure 3D:
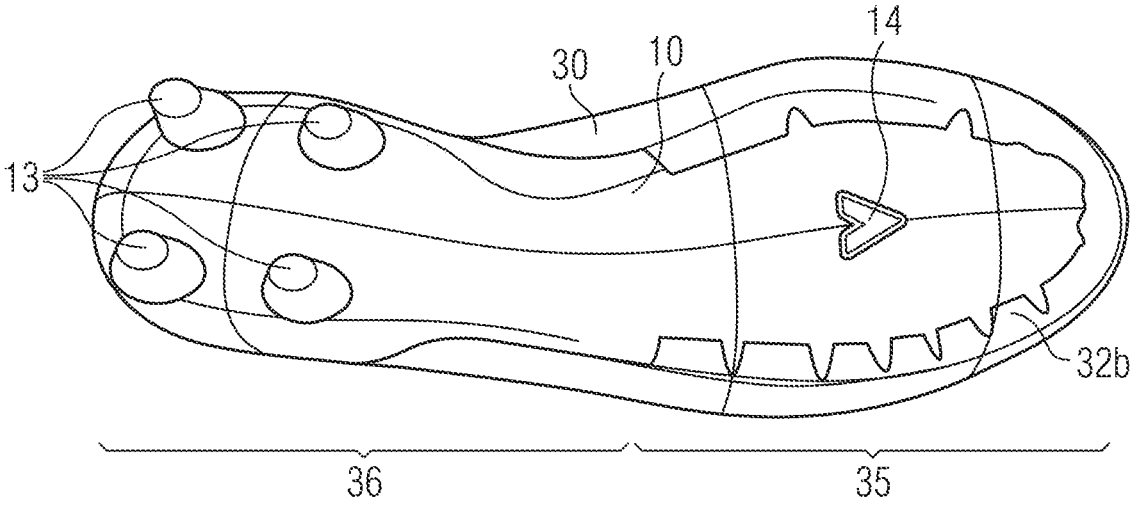

For brevity, FIGS. 3C and 3D comprise only the sheet 37 shown in FIG. 3A, however, the procedure for the sheet 37 with the cut-out region 38 shown in FIG. 3B is analogous.

FIG. 3C shows how the upper 30 can be lasted on a last 33. The last comprises a rim 34 to which the ears 32 can be temporarily attached to facilitate consolidation during lasting.

FIG. 3D shows how a first part 30*a* of the upper is board-lasted around a first region 35 of the first member 10. The board-lasting involves attaching the inside 32*a* of the ears of the upper to the underside of the first member 10. The outside 32*b* of the ears is still visible in FIG. 3D. This attachment can be facilitated for example by gluing with a suitable adhesive. This arrangement allows to directly last the upper onto the first member in the first region. This makes an insole board redundant and reduces the number of components and the weight of the article of footwear while maintaining good mechanical stability.

FIG. 3D also shows how the second part 30*b* of the upper is attached to a second region 36 of a first member 10 by means of attaching the sheet 37 to the first member 10, for example by use of an adhesive or by welding. This construction allows the overall weight of the article of footwear to be reduced as it is more lightweight than the configuration in the first region 35. It is also faster and easier to assemble the article of footwear in this second region 36 than to perform the board lasting in the first region 35.

In a further method step (not shown), a second member 20 is attached to the first member. The second member is attached in such a way as to "sandwich" the ears 32 in the first region 35 between the first and the second member. The alignment of the first member 10 and the second member 20 is preferably facilitated by an alignment stud 14 in the first member and a corresponding alignment hole 24 in the second member. The second member 20 is preferably attached to the first member 10 by an adhesive to facilitate a strong permanent bond.

However, it is also possible to attach the second member 20 to the first member 10 in a detachable manner, e.g. using a screw in the second member and a corresponding thread in the first member 10.

Regardless of whether the second member 20 is attached to the first member 10 in a detachable or permanent manner, the second member 20 is preferably attached to the first member such that the second member covers at least part of both regions 35 and 36, that is, the second member covers the transition point between the board-lasted region 35 and the sewn/glued/welded region 36. It is beneficial if this transition point is covered by the first member because the upper could tear at this point or detach from the first and/or second member. The transition point must be carefully selected because if the board lasting is cut off too early, that is if the board lasted area 35 is too short, the interface between the skin and the chassis won't be flush at the transition point which is required for the mechanical stability, especially of cleated footwear. If, however, the board lasted area 35 is too long, the weight of the article of footwear is increased unnecessarily.

Preferably, the first region 35 is located in a forefoot region 15 of the first member 10 and the second region 36 is located in a heel/shank region 16 of the first member 10. This is because the board-lasted region 35 provides a higher stability than the second region 36 and typically the forefoot region of cleated footwear requires more stability than the heel/shank region.

In the following, further examples are described to facilitate the understanding of the invention:

1. An article of cleated footwear comprising:
   a. an outsole plate comprising:
      (i) a rigid first member (10), extending substantially along the length of the outsole, and
      (ii) a rigid second member (20),
      (iii) wherein the second member (20) is attached to the first member (10),
      (iv) wherein the first member (10) and/or the second member (20) has a ground-engaging profile (13, 23);
   b. an upper (30) attached to the first member (10).

2. The article of cleated footwear according to the preceding example, wherein: (a) a first part of the upper (30*a*) is lasted around a first region (35) of the first member (10); and (b) the second member (20) is attached to the first member (20) such that at least a portion of the first part of the upper (30*a*) is arranged between the first member (10) and the second member (20) in at least a portion of the first region (35).

3. The article of cleated footwear according to one of the preceding examples, wherein a second part of the upper (30*b*) is sewn to a sheet (37) and the sheet (37) is attached to a second region (36) of the first member (10).

4. The article of cleated footwear according to examples 2 and 3, wherein the second member (20) of the outsole plate extends over at least a portion of the second region (36) and a portion of the first region (35), such that the second member (20) covers the transition point between the second region (36) and the first region (35).

5. The article of cleated footwear according to one of examples 2 to 4: (a) wherein the second region (36) comprises a heel region (16) and/or a shank region (16) of the article of cleated footwear; and/or (b) wherein the first region (35) comprises a forefoot region (15) of the article of cleated footwear.

6. The article of cleated footwear according to one of examples 3 to 5, wherein the sheet (37) comprises a cut-out region (38).

7. The article of cleated footwear according to one of examples 3 to 6, wherein the sheet (37) comprises a synthetic material, leather, and/or a textile.

8. The article of cleated footwear according to one of examples 3 to 7, wherein the sheet (37) is attached to the first member by means of an adhesive and/or by welding.

9. The article of cleated footwear according to one of the preceding examples, wherein (a) the first member (10) comprises a first ground-engaging profile (13), which comprises at least one stud of a first type (13); and/or (b) the second member (20) comprises a second ground-engaging profile (23), which comprises at least one stud of a second type (23).

10. The article of cleated footwear according to one of the preceding examples, wherein the second member (20) is shorter along a longitudinal direction of the footwear than the first member (10).

11. The article of cleated footwear according to one of the preceding examples, wherein the second member (20) comprises at least one positioning hole (24) and the first member (10) comprises at least one positioning stud (14) which is fitted in a formfitting manner into said positioning hole (24).

12. The article of cleated footwear according to one of the preceding examples, wherein the first member (10) and/or the second member (20) contains weight-reducing perforations (12, 22).

13. The article of cleated footwear according to one of the preceding examples, wherein the first member (10) comprises a heel counter (17).

14. The article of cleated footwear according to one of the preceding examples, wherein the second member (20) comprises a spine (21) fitted in a formfitting manner into a corresponding recess (11) in the first member (10).

15. The article of cleated footwear according to one of the preceding examples, wherein the first member (10) is made from polyamide 11 and/or polyamide 12 and/or wherein the second member (20) is made from thermoplastic polyurethane, polyurethane, or polyether block amide.

16. The article of cleated footwear according to one of the preceding examples, wherein the second member (20) is attached to the first member (10) in a non-detachable manner.

17. The article of cleated footwear according to one of examples 1 to 15, wherein the second member (20) is attached to the first member (10) in a detachable manner.

18. A method for producing an article of cleated footwear, comprising:

a. supplying an outsole plate comprising:
   (i) forming a rigid first member (10), extending substantially along the length of the outsole, and
   (ii) forming a rigid second member (20), wherein the first member (10) and/or the second member (20) comprises a ground-engaging profile (13, 23);
b. supplying an upper (30);
c. attaching the upper (30) to the first member (10);
d. attaching the first member (10) to the second member (20).

19. The method for producing an article of cleated footwear according to the preceding example, wherein attaching the upper (30) to the first member (10) comprises: (a) lasting a first part of the upper (30*a*) around a first region (35) of the first member (10); and (b) arranging at least a portion of the first part of the upper (30*a*) between the first member (10) and the second member (20) in at least a portion of the first region (35).

20. The method for producing an article of cleated footwear according to one of the preceding examples, wherein the upper is attached to the first member (10) by sewing a second part of the upper (30*b*) to a sheet (37) and attaching the sheet (37) to a second region (36) of the first member (10).

21. The method for producing an article of cleated footwear according to examples 19 and 20, further comprising arranging the second member (20) of the outsole plate to extend over at least a part of the second region (36) and a part of the first region (35), such that the second member (20) covers the transition point between the second region (36) and the first region (35).

22. The method for producing an article of cleated footwear according to one of examples 19 to 21, further comprising: (a) arranging the second region (36) in a heel region (16) and/or a shank region (16) of the article of cleated footwear; and/or (b) arranging the first region (35) in a forefoot region (15) of the article of cleated footwear.

23. The method for producing an article of cleated footwear according to examples 20 to 22, further comprising forming a cut-out region (38) in the sheet (37).

24. The method for producing an article of cleated footwear according to examples 20 to 23, wherein the sheet (37) is made from a synthetic material, leather, and/or a textile.

25. The method for producing an article of cleated footwear according to examples 20 to 24, wherein attaching the sheet (37) to the first member comprises using an adhesive and/or welding.

26. The method for producing an article of cleated footwear according to examples 18 to 25, wherein the first (10) member and/or second (20) member are formed by injection-molding.

27. The method for producing an article of cleated footwear according to one of examples 18 to 26, wherein: (a) the first member (10) comprises a first ground-engaging profile (13), which comprises at least one stud of a first type (13); and/or (b) the second member (20) comprises a second ground-engaging profile (23), which comprises at least one stud of a second type (23).

28. The method for producing an article of cleated footwear according to one of examples 18 to 27, wherein the second member (20) is formed to be shorter along a longitudinal direction of the outsole than the first member (10).

29. The method for producing an article of cleated footwear according to one of examples 18 to 28, further comprising forming at least one positioning hole (24) in the second member (20) and at least one positioning stud (14) in the first member (10), wherein the positioning stud (14) is fitted in a formfitting manner into the positioning hole (24), when the first member (10) is attached to the second member (20).

30. The method for producing an article of cleated footwear according to one of examples 18 to 29, further comprising forming weight-reducing perforations (12, 22) in the first member (10) and/or the second member (20).

31. The method for producing an article of cleated footwear according to one of examples 18 to 30, further comprising forming a heel counter (17) in the first member (110).

32. The method for producing an article of cleated footwear according to one of examples 18 to 31, further comprising forming a spine (21) in the second member (20) and forming a corresponding recess (11) in the first member (10).

33. The method for producing an article of cleated footwear according to one of examples 18 to 32, wherein the first member (10) is made from polyamide 11 and/or polyamide 12 and/or the second member (20) is made from thermoplastic polyurethane, polyurethane, or polyether block amide.

34. The method for producing an outsole plate for an article of cleated footwear according to one of examples 18 to 33, wherein attaching the first member (10) to the second member (20) forms a non-detachable connection.

35. The method for producing an article of cleated footwear according to one of examples 18 to 34, wherein attaching the first member (10) to the second member (20) forms a detachable connection.

It should be emphasized that the above-described aspects are merely possible examples of implementations, merely set forth for a clear understanding of the principles of the present disclosure. Many variations and modifications can be made to the above-described embodiment(s) without departing substantially from the spirit and principles of the present disclosure. All such modifications and variations are intended to be included herein within the scope of the present disclosure, and all possible claims to individual aspects or combinations of elements or steps are intended to be supported by the present disclosure. Moreover, although specific terms are employed herein, as well as in the claims that follow, they are used only in a generic and descriptive sense, and not for the purposes of limiting the described invention, nor the claims that follow.

That which is claimed:

1. An article of cleated footwear comprising:

an outsole plate comprising:

a rigid first member extending substantially along a length of the outsole plate, and a rigid second member, wherein a length of the second member is less than a length of the first member, wherein the second member is attached to the first member and such that the second member vertically overlaps at least a portion of the first member and is an outermost surface of the overlapped portion of the first member, wherein each of the first member and the second member has a ground-engaging profile; and an upper attached to the first member of the outsole plate, wherein a first part of the upper is lasted around a first region of the first member such that at least a portion of the first part of the upper is arranged between the first member and the second member in at least a portion of the first region, and wherein a second part of the upper is sewn to a sheet and the sheet is attached to a second region of the first member.

2. The article of cleated footwear according to claim 1, wherein the second member of the outsole plate extends over at least a portion of the second region and a portion of the first region such that the second member covers a transition point between the second region and the first region.

3. The article of cleated footwear according to claim 1, wherein the second region comprises at least one of a heel region or a shank region of the article of cleated footwear, and wherein the first region comprises a forefoot region of the article of cleated footwear.

4. The article of cleated footwear according to claim 1, wherein the sheet comprises a cut-out region.

5. The article of cleated footwear according to claim 1, wherein:

the ground-engaging profile of the first member comprises a first ground-engaging profile that comprises at least one stud of a first type; and the ground-engaging profile of the second member comprises a second ground-engaging profile that comprises at least one stud of a second type.

6. The article of cleated footwear according to claim 1, wherein at least one of the first member or the second member comprises weight-reducing perforations.

7. The article of cleated footwear according to claim 1, wherein the first member comprises a heel counter.

8. The article of cleated footwear according to claim 1, wherein the second member comprises a spine fitted in a formfitting manner into a corresponding recess in the first member.

9. The article of cleated footwear according to claim 1, wherein the second member comprises at least one positioning hole, and wherein the first member comprises at least one positioning stud which is fitted into said positioning hole of the second member and extends through the positioning hole of the second member and below the positioning hole, wherein the positioning stud and the positioning hole are offset from the ground-engaging profiles of the first member and the second member.

10. The article of cleated footwear of claim 8, wherein the second member comprises a forefoot region and a heel region, wherein the spine is in the heel region, and wherein a width of the spine in the heel region is less than the width of the second member in the forefoot region.

11. The article of cleated footwear of claim 1, wherein the outsole plate comprises a forefoot region, a heel region, and a transition region between the forefoot region and the heel region, and wherein the first member and the second member are flush at the transition region.

12. The article of cleated footwear of claim 1, wherein:

the ground-engaging profile of the first member extends from a first region of a surface of the first member, and the surface of the first member comprises a second region;

the ground-engaging profile of the second member extends from a first region of a surface of the second member, and the surface of the second member comprises a second region; and the second region of the surface of the first member and the second region of the surface of the second member are each outermost surfaces of the outsole.

* * * * *